US008146768B2

(12) United States Patent
Forrest et al.

(10) Patent No.: US 8,146,768 B2
(45) Date of Patent: Apr. 3, 2012

(54) TAB WITH EMBOSS AND DEBOSS BEADS

(75) Inventors: Randall G. Forrest, Park Ridge, IL (US); Timothy L. Turner, Port Charlotte, FL (US)

(73) Assignee: Rexam Beverage Can Company, Chicago, IL (US)

( * ) Notice: Subject to any disclaimer, the term of this patent is extended or adjusted under 35 U.S.C. 154(b) by 504 days.

(21) Appl. No.: 12/365,696

(22) Filed: Feb. 4, 2009

(65) Prior Publication Data

US 2010/0193519 A1 Aug. 5, 2010

(51) Int. Cl.
*B65D 17/34* (2006.01)

(52) U.S. Cl. ..... 220/272; 220/253; 220/269; 220/376; 220/906; 413/14; 413/16; 40/311

(58) Field of Classification Search ..... 220/253, 220/269, 272, 376, 906; 413/14, 16; 40/311
See application file for complete search history.

(56) References Cited

U.S. PATENT DOCUMENTS

| | | | |
|---|---|---|---|
| 1,257,710 | A | 2/1918 | Januchowsky |
| 1,878,541 | A | 9/1932 | Reinhold |
| D212,462 | S | 10/1968 | Peters et al. |
| D215,415 | S | 9/1969 | Peters et al. |
| 3,559,842 | A | 2/1971 | Rich |
| D221,736 | S | 9/1971 | Jacobs et al. |
| D224,964 | S | 10/1972 | Saunders |
| D226,072 | S | 1/1973 | Saunders |
| D228,344 | S | 9/1973 | Markert |
| 3,822,496 | A | 7/1974 | Minder |
| 4,083,471 | A | 4/1978 | Frank |
| 4,203,240 | A | 5/1980 | Goodwin |
| 4,232,797 | A | 11/1980 | Waterbury |

(Continued)

FOREIGN PATENT DOCUMENTS

AU 81794/94 A 9/1995

(Continued)

OTHER PUBLICATIONS

Turner, Timothy L., et al., "Promotional Tabs for Container Ends," non-published U.S. Appl. No. 09/156,563 deposited Sep. 17, 1998.

(Continued)

*Primary Examiner* — Anthony Stashick
*Assistant Examiner* — Madison L Wright
(74) *Attorney, Agent, or Firm* — Ungaretti & Harris LLP

(57) ABSTRACT

A container has a selectively openable panel defined at least in part by a frangible score groove in a surface of the container. The frangible score groove is selectively fracturable by a lifting action administered by a user to a secured to the container. The tab has a nose portion separated from a lift end by a central webbing. The central webbing has a hinge region and a rivet island. The rivet island is at least partially surrounded by a first void region. The central webbing also has a grab portion at the lift end of the tab. The grab portion has an enclosed region defining a billboard surface. The billboard surface has a top side and a bottom side opposite the top side. A bead created by displacing the material of the central webbing is located on the billboard surface. A pigment-carrying layer covers at least a portion of the billboard surface. A tactile indicium is located on the billboard surface.

19 Claims, 8 Drawing Sheets

U.S. PATENT DOCUMENTS

| | | | | |
|---|---|---|---|---|
| 4,322,016 | A | | 3/1982 | Barrash |
| 4,380,129 | A | | 4/1983 | Barrash |
| 4,459,910 | A | | 7/1984 | Taube |
| 4,557,505 | A | | 12/1985 | Schaefer et al. |
| D289,017 | S | | 3/1987 | Spangler et al. |
| 4,880,137 | A | | 11/1989 | Wells |
| 5,191,695 | A | | 3/1993 | Pavely et al. |
| 5,215,864 | A | | 6/1993 | Laakmann |
| 5,316,166 | A | | 5/1994 | Pavely et al. |
| 5,359,766 | A | | 11/1994 | Pavely et al. |
| D365,021 | S | | 12/1995 | Park |
| 5,655,678 | A | * | 8/1997 | Kobayashi ..... 220/269 |
| 5,741,105 | A | | 4/1998 | Schubert et al. |
| 5,799,815 | A | | 9/1998 | Lang |
| 5,855,969 | A | | 1/1999 | Robertson |
| 5,967,726 | A | | 10/1999 | Turner et al. |
| D422,211 | S | * | 4/2000 | Sedgeley ..... D9/434 |
| D423,932 | S | | 5/2000 | Miura |
| 6,080,958 | A | | 6/2000 | Miller et al. |
| 6,105,806 | A | | 8/2000 | Stasiuk |
| 6,161,717 | A | | 12/2000 | Forrest et al. |
| 6,202,880 | B1 | | 3/2001 | Strube et al. |
| 6,433,302 | B1 | | 8/2002 | Miller et al. |
| 6,476,349 | B1 | | 11/2002 | Jendick |
| 6,498,318 | B1 | | 12/2002 | Miller et al. |
| 6,501,046 | B1 | | 12/2002 | Miller et al. |
| 6,590,183 | B1 | | 7/2003 | Yeo |
| 6,706,995 | B2 | | 3/2004 | Miller et al. |
| 6,777,098 | B2 | | 8/2004 | Yeo |
| 6,808,351 | B1 | | 10/2004 | Brown et al. |
| 6,854,947 | B2 | | 2/2005 | Lee |
| 6,868,627 | B2 | | 3/2005 | Elias |
| 6,926,487 | B1 | | 8/2005 | Jendick |
| 6,951,293 | B2 | | 10/2005 | Thibaut |
| D530,604 | S | | 10/2006 | Huckel |
| D531,899 | S | | 11/2006 | Huckel |
| D533,775 | S | | 12/2006 | Huckel |
| 2003/0178397 | A1 | | 9/2003 | Jendick |
| 2005/0045637 | A1 | | 3/2005 | Rohr et al. |
| 2005/0258175 | A1 | | 11/2005 | Robertson |
| 2006/0140746 | A1 | | 6/2006 | Koon |
| 2006/0151501 | A1 | | 7/2006 | Chang et al. |

FOREIGN PATENT DOCUMENTS

| | | | |
|---|---|---|---|
| DE | 29716186 | U1 | 11/1997 |
| DE | 19701547 | A1 | 3/1998 |
| EP | 0923457 | B1 | 6/1999 |
| EP | 1123772 | A1 | 8/2001 |
| EP | 1663794 | B1 | 1/2007 |
| GB | 2105257 | A | 3/1983 |
| GB | 2185613 | A | 7/1987 |
| GB | 2320008 | A | 6/1998 |
| JP | 5178346 | A | 7/1993 |
| WO | 98/10945 | A1 | 3/1998 |
| WO | 99/09853 | A2 | 3/1999 |
| WO | 99/58407 | A1 | 11/1999 |
| WO | 00/03832 | A1 | 1/2000 |
| WO | 00/47487 | A1 | 8/2000 |
| WO | 01/68460 | A2 | 9/2001 |
| WO | 0228730 | A1 | 4/2002 |
| WO | 2005/021392 | A1 | 3/2005 |

OTHER PUBLICATIONS

Rexam Beverage Can Company, International Search Report from co-pending Application No. PCT/US2010/023055 mailed Mar. 25, 2010 from the European Patent Office acting as International Searching Authority.

* cited by examiner

TAB WITH EMBOSS AND DEBOSS BEADS

CROSS-REFERENCE TO RELATED APPLICATIONS

N/A

FEDERALLY SPONSORED RESEARCH OR DEVELOPMENT

N/A

TECHNICAL FIELD

The invention relates to beverage containers. More particularly, the invention relates to stay-on tabs having emboss and deboss strengthening beads carrying indicia formed on an increased area.

BACKGROUND OF THE INVENTION

Typical end closures for beer and beverage containers have an opening panel and an attached leverage tab for pushing the opening panel into the container to open the end. The container is typically a drawn and ironed metal can, usually constructed from a thin plate of aluminum or steel. End closures for such containers are also typically constructed from a cutedge of thin plate of aluminum, formed into a blank end, and manufactured into a finished end by a process often referred to as end conversion. These ends are formed in the process of first forming a cutedge of thin metal, forming a blank end from the cutedge, and converting the blank into an end closure which may be seamed onto a container.

These types of container ends have been used for many years, with almost all such ends in use today being the "ecology" or "stay-on-tab" ("SOT") ends in which the tab remains attached to the end after a tear panel, including large-opening ends ("LOE"), is opened. The tear panel being a portion of the can end defined by a score length. The tear panel may be opened, that is the score may be severed, and the tear panel displaced at an angular orientation relative to the remaining portion of the can end. The tear panel remains hingeably connected to the remaining portion of the can end by a hinge segment, leaving an opening through which the user draws the contents of the container. In an LOE, the opening is at least 0.5 square inches in area.

Opening of the tear panel is operated by the tab which is attached to the can end by a rivet. The tab is attached to the can end such that a nose of the tab extends over a proximal portion of the tear panel. A lift end of the tab is located opposite the tab nose and provides access for a user to lift the lift end, such as with the user's finger, to force the nose against the proximal portion of the tear panel.

When the tab nose is forced against the tear panel, the score initially ruptures at a vent region of the score. This initial rupture of the score is primarily caused by the lifting force on the tab resulting in lifting of a central region of the can end, immediately adjacent the rivet. As the tab is lifted further, the score rupture propagates along the length of the score, eventually stopping at the hinge segment.

Tabs are often also used to convey information to users. This information may be in the form of promotional materials, logos, or the like. Methods such as printing, incising, laser ablation, stamping, etc. have been employed to provide information on the tabs. To date, none of these methods has been widely accepted.

Some publications dedicated to methods of conveying information to a user in conjunction with beverage containers include: U.S. Publication No. 2006/0151501 which discloses a protective sanitary film for coating a can lid; U.S. Pat. No. 1,257,710 which describes a crimped bottle cap; U.S. Pat. No. 4,380,129 which described information-bearing tabs; U.S. Pat. No. 1,878,541 which describes an impressed cap; U.S. Pat. No. 4,203,240 which describes placing indicia on a beverage container; U.S. Pat. No. 4,459,910 which describes an embossing machine having upper tooling including multiple embossing stamps and lower tooling including an anvil only; U.S. Pat. No. 4,557,505 which discloses tamper evident tape; U.S. Pat. No. 5,191,695 which discloses a token which is insertable into the finger hole of a tab, which token may be marked by molding, embossing, hot die stamping, or ink jet printing where embossing is used only when thickness of tab is so great that indicia will not show through; U.S. Pat. No. 5,316,166 which is similar to U.S. Pat. No. 5,191,695; U.S. Pat. Nos. 6,080,958, 6,433,302, 6,501,046, 6,706,995 and 6,498,318 which describe marking tabs with embossing via stamping or incising; U.S. Pat. No. 6,105,806 which is primarily dedicated to a laser etched image on a tab; U.S. Pat. No. 6,202,880 which discloses a second score having a shape and laser markings; U.S. Pat. No. 6,777,098 which discloses laser marking an anodized aluminum; and U.S. Pat. No. 6,868,627 which describes indicia on a tab which indicia may consist of a mark, shape, depression, cut, mold, impression.

Other publications which may be relevant to providing indicia on non-detachable tabs includes AU-784218, DE-19701547, DE-29716186, EP-0923457, GB-2105257, JP-3146174, WO-00/03832, WO-01/68460, WO-98/10945, and WO-99/09853.

The present invention is provided to solve the problems discussed above and other problems, and to provide advantages and aspects not provided by prior can end tabs of this type. A full discussion of the features and advantages of the present invention is deferred to the following detailed description, which proceeds with reference to the accompanying drawings.

SUMMARY OF THE INVENTION

One aspect of the present invention is directed to a tab for a container of the type having a selectively openable panel defined at least in part by a frangible score groove in a surface of the container. The frangible score groove is selectively fracturable by a lifting action administered by a user to the tab. The tab comprises a nose portion, a lift end opposite the nose portion, a central webbing, and a bead. The central webbing is located between the nose portion and the lift end, and has a hinge region and a rivet island. The rivet island is at least partially surrounded by a first void region. The central webbing further has a grab portion at the lift end of the tab. The grab portion has an enclosed region defining a billboard surface having a top side and a bottom side opposite the top side. A bead created is formed on the billboard surface by a displacing a portion of the central webbing. The bead may carry a tactile indicium.

The first aspect of the present invention may further comprise a pigment-carrying layer covering at least a portion of the billboard surface.

The tactile indicium of the first aspect of the invention may comprise relief features on the top and bottom sides. The relief features may comprise an embossed figure on the top side and a corresponding debossed figure on the bottom side.

The first aspect of the invention may further comprise a pigment-carrying layer wherein the tactile indicium overlaps a portion of the pigment-carrying layer. The pigment-carrying layer may have a profile shape substantially matching a profile shape of the tactile indicium.

The billboard surface of the first aspect of the invention may have a width that is at least 50% greater than a width of the tab across the rivet. The billboard surface may be substantially fan-shaped and have a width at least 50% greater than a width of the tab taken through the rivet island.

The first aspect of the present invention may further comprise a pigment-carrying layer located on the top side of the billboard surface wherein the tactile indicium includes an embossed figure on the top side of the billboard surface substantially corresponding in size, shape, and location to a size, shape and location of the pigment-carrying layer.

The first aspect of the present invention may further comprise a plurality of pigment-carrying layers each having a separate pigment characteristic. Further, the tactile indicium may have a profile shape corresponding in size, shape and location on the billboard surface to an overall profile of the plurality of pigment-carrying layers wherein each pigment-carrying layer represents a separate feature of the tactile indicium. Still further, the tactile indicium may include a first relief feature on the top side of the billboard surface and a second relief feature on the bottom side of the billboard surface. The first relief feature may be an embossed figure, and the second relief figure may be a debossed figure.

A second aspect of the present invention is also directed to a tab. The tab comprises a nose portion, and opposite lift end, a central webbing, and an indicium. The central webbing is located between the nose portion and the lift end and has a hinge region and a rivet island. The rivet island is at least partially surrounded by a first void region. The central webbing further has a grab portion at the lift end. The grab portion has an enclosed region defining a billboard surface having a top side and a bottom side opposite the top side. The indicium is located on the billboard surface and comprises tactile features on the top and bottom sides.

The indicium of this aspect of the invention may an embossed figure and a debossed figure. The indicium may further comprise a first layer of a pigment-carrying material. The indicium may further comprise a second layer of a pigment-carrying material having a distinct visual characteristic from the first layer. The embossed figure and the first and second layers may be located on the top side of the billboard surface.

Another aspect of the present invention is directed to a can end for a container. The can end comprises a curl defining an outer perimeter of the can end, a wall extending downwardly from the curl, a strengthening member joined to a lowermost end of the wall, a center panel, and a non-detachable tab. The center panel is joined to the strengthening member and centered about a longitudinal axis, and the center panel has a displaceable tear panel center panel at least substantially defined by a frangible score and a non frangible hinge segment. The non-detachable tab is staked to the panel by a rivet. The non-detachable tab has a nose end extending over a portion of the tear panel, a lift end opposite the nose end, and a central webbing between the nose and lift end. The webbing has a hinge region and a rivet island surrounding the rivet. The rivet island is at least partially surrounded by a first void region to provide a first exposed area of the center panel. The non-detachable tab further has an indicium-bearing grab portion having a width at least 50% wider than a width of the tab intersecting the rivet.

The center panel of the can end of this aspect of the invention may include a deboss panel recessed therein where the tab is located within the deboss panel. The deboss panel has a deboss profile including a first zone, within which the grab portion is located, that is fanned outwardly from a narrower intermediate zone in the vicinity of the rivet which widens to a third zone in which the tear panel is located. The first zone is at least as wide at its widest point as the third zone at its widest point.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which.

DETAILED DESCRIPTION

Figure 1:
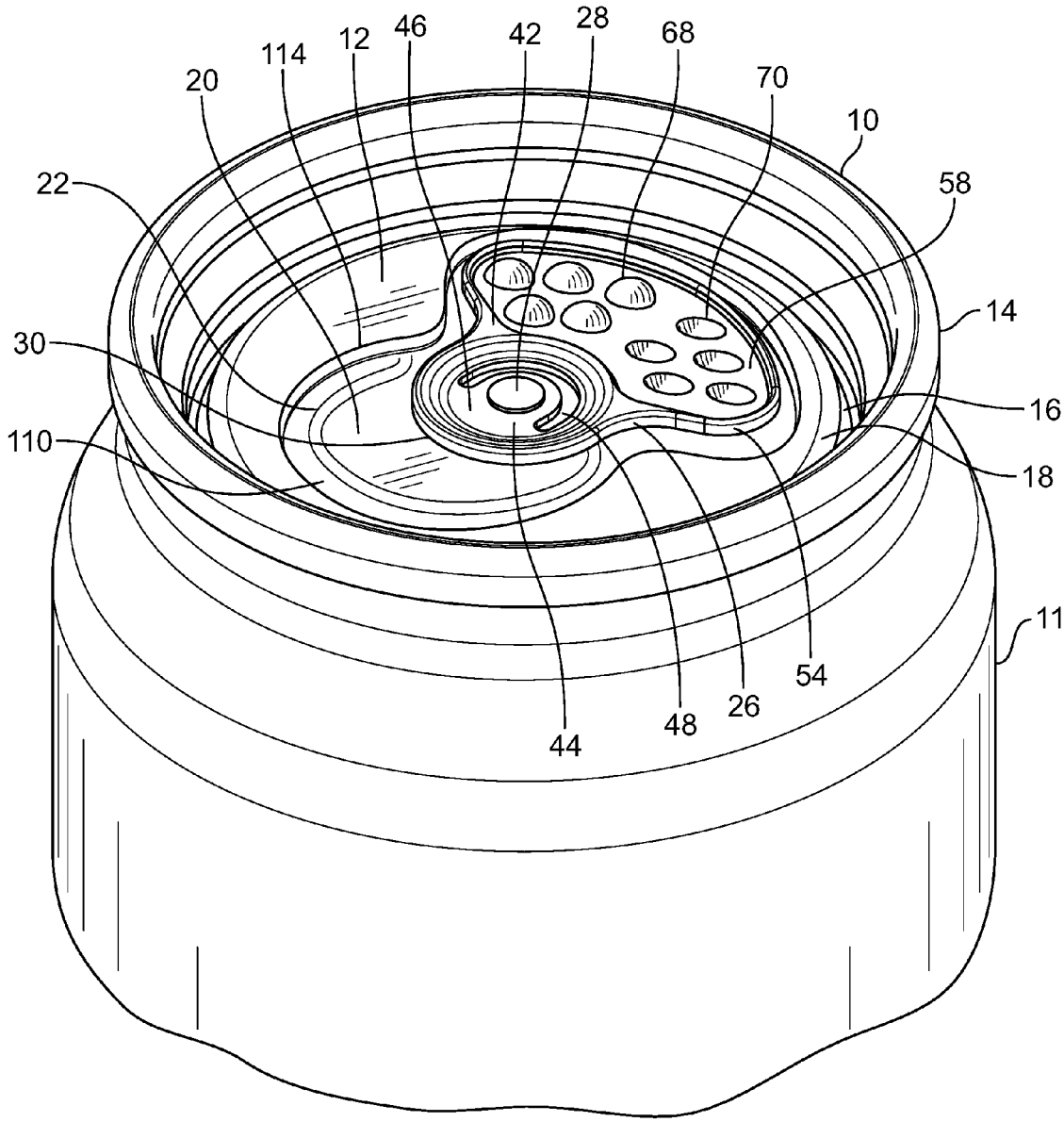
FIG. 1 is a perspective view of a can end having a tab with emboss and deboss beads for strengthening the lift end of the tab.

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

As shown in FIG. 1, the end closure 10 for a container 11 (partially shown) has a central panel wall 12 having a seaming curl 14 for joining the wall to the container. The container is typically a drawn and ironed metal can, usually constructed from a thin plate of aluminum or steel. End closures for such containers are also typically constructed from a cutedge of thin plate of aluminum or steel, formed into blank end, and manufactured into a finished end by a process often referred to as end conversion. In the embodiment shown in the Figures, the central panel 12 is joined to a container by a seaming curl 14 which is joined to a mating curl of the container. The seaming curl 14 of the end closure 10 is integral with the central panel 12 by a strengthening member 16, typically either a countersink or a fold, which is joined to the panel outer edge 18 of the central panel 12. This type of means for joining the central panel 12 to a container is presently the typical means for joining used in the industry, and the structure described above is formed in the process of forming the blank end from a cutedge of metal plate, prior to the end conversion process. However, other means for joining the central panel to a container may be employed with the present invention.

The steps of manufacturing the end begin with blanking the cutedge, typically a round or non-round cutedge of thin metal plate. Examples of non-round cutedge blanks include elliptical cutedges, convoluted cutedges, and harmonic cutedges. A convoluted cutedge may be described as generally having three distinct diameters, each diameter being 45° relative to the others. The cutedge is then formed into a blank end by forming the seaming curl, countersink, panel radius and the central panel.

The conversion process for this type of end closure includes the following steps: forming a rivet by first forming a projecting bubble in the center of the panel and subsequently working the metal of the bubble into a button and into the more narrow projection of metal being the rivet; forming the tear panel by scoring the metal of the panel wall; forming an inner bead or panel on the tear panel; forming a deboss panel by bending the metal of the panel wall such that a central area of the panel wall is slightly lower than the remaining panel wall; staking the tab to the rivet; and other subsequent operations such as wipe-down steps to remove sharp edges of the tab, lettering on the panel wall by scoring, incising, or embossing (or debossing), and restriking the rivet island.

The central panel wall 12 has a displaceable tear panel 20 defined by a frangible score 22 and a non-frangible hinge segment. The tear panel 20 of the central panel 12 may be opened, that is the frangible score 22 may be severed and the tear panel 20 displaced at an angular orientation relative to the remaining portion of the central panel 12, while the tear panel 20 remains hingeably connected to the central panel 12 through the hinge segment. In this opening operation, the tear panel 20 is displaced at an angular deflection. More specifically, the tear panel 20 is deflected at an angle relative to the plane of the panel 12, with the vortex of the angular displacement being the hinge segment.

The tear panel 20 is formed during the conversion process by a scoring operation. The tools for scoring the tear panel 20 in the central panel 12 include an upper die on the public side having a scoring knife edge in the shape of the tear panel 20, and a lower die on the product side to support the metal in the regions being scored. When the upper and lower dies are brought together, the metal of the panel wall 12 is scored between the dies. This results in the scoring knife edge being embedded into the metal of the panel wall 12, forming the score which appears as a wedge-shaped recess in the metal. The metal remaining below the wedge-shaped recess is the residual of the score 22. Therefore, the score is formed by the scoring knife edge causing movement of metal, such that the imprint of the scoring knife edge is made in the public side of the panel wall 12.

The central panel 12 further includes a tab 26. The tab 26 has a generally elongated body with a central longitudinal axis A-A defined by a central cross section through the tab nose 30, and through a central webbing 42 and the lift end 32. Typical prior art container ends often have a tab 26 which is staked in the final steps of the conversion process by staking the area of the panel wall 12 adjacent and under the rivet island 46 at an angle, to bias the tab 26 such that the lift end 32 of the tab 26 rests close to the panel wall 12. The central panel 12 may also have a recess near the lift end 32 of the tab 26 to allow for easier finger access.

The opening of the tear panel 20 is operated by the tab 26 which is attached to the central panel 12 by a rivet 28, generally through a rivet hole 29. The tab 26 is attached to the central panel 12 such that the nose 30 of the tab 26 extends over a proximal portion of the tear panel 20. The lift end 32 of the tab 26 is located opposite the tab nose 30 and provides access for a user to lift the lift end 32, such as with the user's finger, to force the nose 30 against the proximal portion of the tear panel 20.

When the tab nose 30 is forced against the tear panel 20, the score 22 initially ruptures at the vent region of the score 22 of the tear panel 20. This initial rupture of the score 22 is primarily caused by the lifting force on the tab resulting in lifting of a central region of the center panel, immediately adjacent the rivet 28, which causes separation of the residual metal of the score 22. The force required to rupture the score in the vent region, typically referred to as the "pop" force, is a lower degree of force relative to the force required to propagate other regions of the score 22 by continued lifting of the lift end 32 of the tab 26. Therefore, it is preferable for the panel 12 in the area around the rivet 28 only lifts enough to assist with initial score rupture, or "pop," and remains substantially stiff and flat to provide the needed leverage for the tab 26 to propagate the scoreline of the tear panel 20. The present invention provides such optimal stiffness in the center panel, as is explained further below.

After the initial "pop", or venting of the tear panel, the user continues to lift the lift end 32 of the tab 26 which causes the tab nose 30 to be pushed downward on the tear panel 20 to continue the rupture of the score 22, as an opening force. As the opening operation is continued, the tear panel 20 is displaced downward and is rotated about the hinge region to be deflected into the container.

The tab 26 has a central webbing 42 located between the nose 30 and the lift end 32. The central webbing 42 includes a hinge region 44 and a rivet island 46 surrounding the rivet 28. An opening or void region 48 of the tab webbing 42 provides an exposed area of the central panel 12. The void region 48 has a curvilinear geometry which borders the rivet island 46 and at least partially surrounds the rivet 28, with a first end of the void region 48 being disposed generally to one side of the rivet 28, and a second end being generally disposed on an opposite side of the rivet 28. The hinge region 44 of the tab webbing 42 includes a hinge line which is defined by a substantially straight line passing between the first end and the second end of the void region 48. It may also be necessary to add material to the tab webbing 42, modify the radius of the curl, add beading, or other strengthening means to ensure that this area is strong enough wherein the tab 26 bends at the hinge region 44 during opening.

The void region 48 is within the tab webbing 42. The void region 48 may have a generally arch-shaped configuration. In this configuration, the rivet island 46 again follows the general shape of the void region 48.

The figures represent only one example of the rivet island 46 configuration. However, those individuals who are ordinary skilled in the art would understand that the rivet island 46 and the void region 48 can take any number of shapes without departing from the spirit of the invention, including but not limited to all notch or lance type rivet islands.

The webbing 42 further comprises a grab portion 54. The grab portion 54 is adapted for user manipulation. Typically, the grab portion 54 includes a finger hole or the like. More recently, tabs have included fully closed grab portions onto which information or the like can be etched, stamped, or incised.

Figure 2:
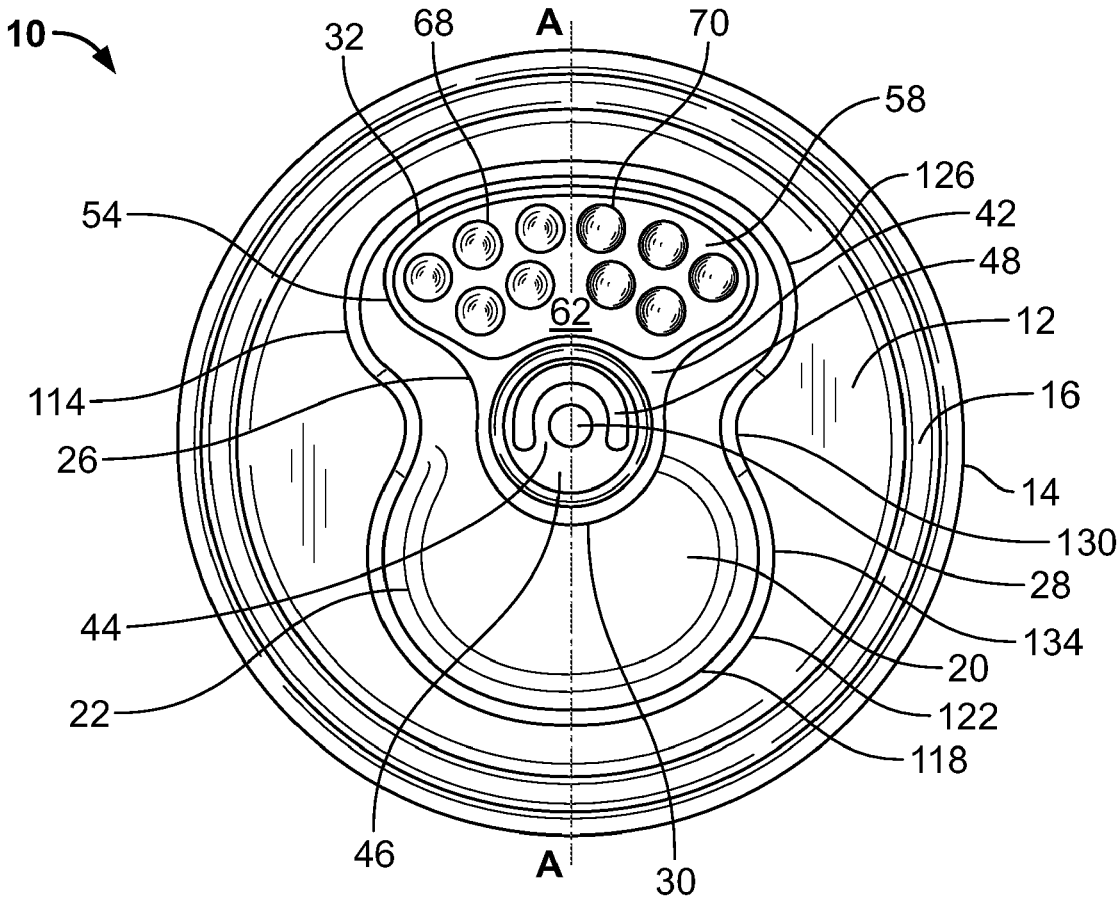
FIG. 2 is a top view of the tap illustrated in FIG. 1.
Figure 3:
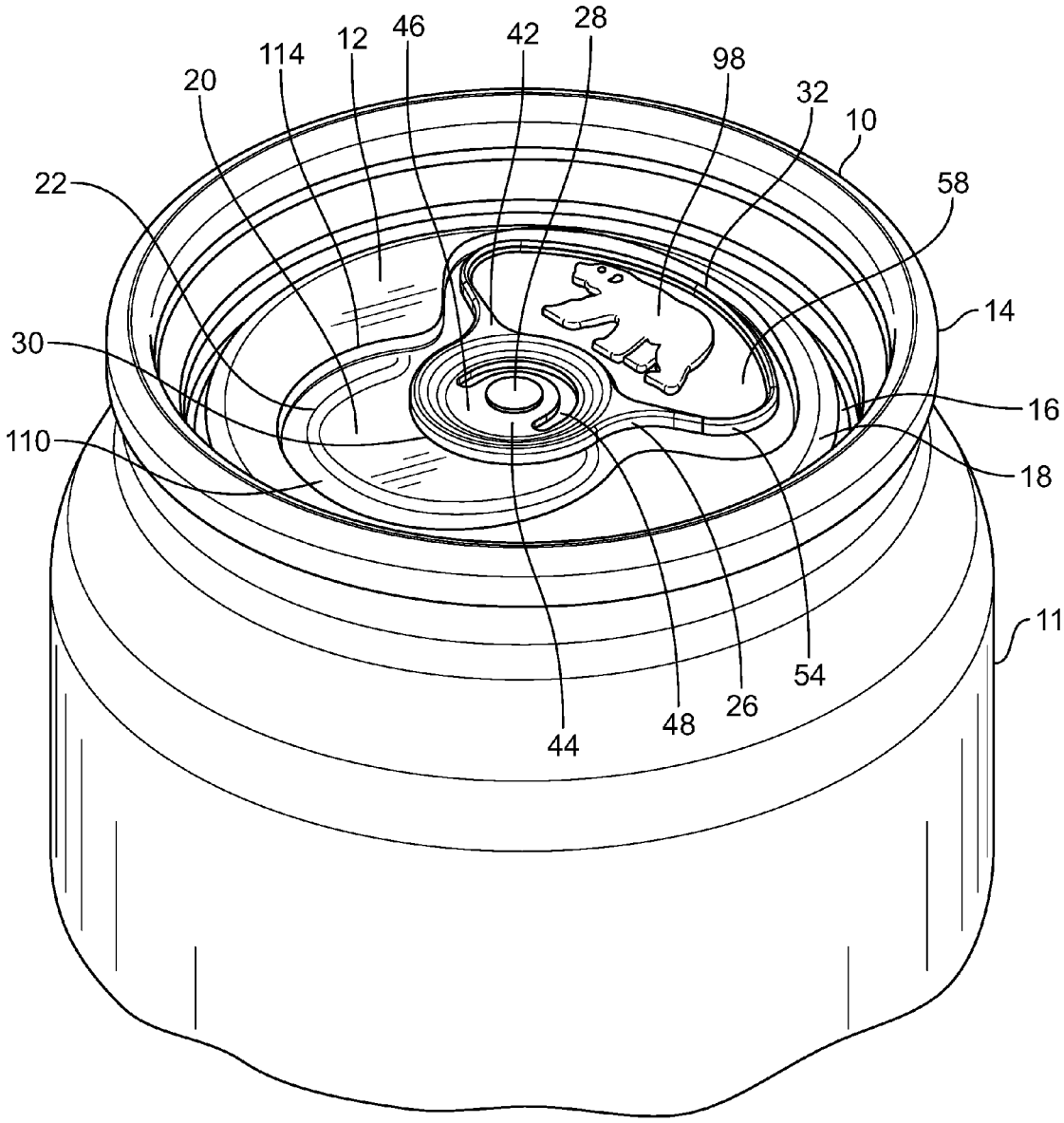
FIG. 3 is a perspective view of a can end having a tab with emboss and deboss beads taking the form of information carrying indicia.

Referring to FIGS. 1 and 2, the present invention includes a grab portion 54 having an enclosed region defining a billboard surface 58. The billboard surface 58 is at least partially closed, and preferably fully closed. The billboard surface 58 has a top side 62 and a bottom side 66.

The grab portion 54 of the tab 26 may be strengthened by displacing the material of the central webbing located in the billboard surface by forming or reforming emboss and deboss beads 68,70 on the billboard surface 58. This beading 68,70 may allow the billboard surface 26, and consequently the tab 26, to be formed from a lesser volume of material than previously used to produce a like tab 26. By adding these strengthening beads 68,70 to the billboard surface 58 excess metal used to roll or curl the edges of the tab 26 for strength may be reduced or altogether eliminated. This is advantageous because reducing the volume of metal used to produce any component of a beverage container is a goal of can manufacturers.

Now referring to FIGS. 3-10, the billboard surface may also comprise information carrying indicia. Surprisingly, the beading may serve another purpose by using the beading to convey information to a user. Here, the billboard surface 58 includes one or more indicia 98. Accordingly, the indicia 98 are preferably tactile, including one or more relief features of the tab material made up of the emboss and deboss beads. The term "relief feature" is intended to be differentiated from incising where the material of the tab is merely stamped or marked with recessed marking of a very shallow, consistent or constant depth. "Relief features" is intended to indicate a variable depth pattern which is less consistent or constant, such as a topographical map may exhibit. This method of providing a tab with relief features allows for much more detailed imagery than ever before attained on tabs of this type which typically rely on incising, stamping or laser ablation for less remarkable imagery.

The relief features are generally present on the top and bottom sides of the billboard surface 58. Preferably, the top side 62 of the billboard surface 58 has an embossed figure while the bottom surface has a debossed figure, although this relationship can be reversed without departing from the spirit of the invention. The debossed figure is preferably substantially the negative of the embossed figure. These features are preferably created between a pair of forming tools 102 and 106, one tool 102 engaging the top side 62 while a complementary tool 106 engages the bottom side 66 in a female/male-type relationship. The resulting tactile indicium 98 is more highly detailed than that achieved via laser etching of an epoxy layer or that achieved via a simple stamps as disclosed in the prior art. Thus, highly detailed and more visually pleasing designs may be added to the billboard surface 58 by cold working the metal of the billboard surface 58 on the top side 62 and the bottom side 66, serving the further purpose of strengthening the tab 26 at the grab portion 54. This adds the unexpected benefit of strengthening this portion of the tab 26 and possibly allowing thinner material to be used to manufacture the tab 26. In other words, the embossed figure and the debossed figure each have profile shapes which substantially correspond to each other. The embossed figure has relief details which are the negative of relief details of the debossed figure, wherein more highly raised details of the embossed figure will have a corresponding more recessed detail on the debossed figure on the reverse side of the billboard surface 58. The unexpected result of forming more visually stimulating indicia having greater detail than achieved in prior art tabs of this kind is a stronger grab portion provided by the forming technique described.

The grab portion 54 and the billboard surface 58 are preferably relatively large in comparison to other portions of the tab 26. For instance, the grab portion 54 may have a width measured between the widest segments 59 of the grab portion 54 which is at least 50% wider than a width of the tab 26 as measured through a parallel segment intersecting the rivet hole 29, preferably 10% to 100% wider, more preferably 25% to 100% wider, and most preferably 50% to 100% wider, or any range or combination of ranges therein. This creates an enlarged billboard surface 58 having a similar size ratio which lends itself to the information carrying or displaying indicium or indicia, which again may also serve as stiffening beads of reformed metal. The grab portion 54 and the billboard surface 58 preferably have a fan-shaped appearance, wider at the lift end 32 of the tab 26 and tapering inwardly towards the rivet. This fan-shape also lends itself to an arcuate lift end 32 of the tab 26.

The novel shape of the tab 26 requires a novel deboss panel 110 to allow the tab 26 to fit fully within the bounds of a deboss panel profile 114. The deboss panel 110 is formed in the public side of the central panel 12. The deboss panel 110 using conventional die-forming techniques. The deboss panel 110 has a novel deboss profile 114 which is defined by an inner radius line 118 and an outer radius line 122. The deboss panel 110 may have bilateral symmetry.

The deboss profile 114 includes first and second opposing end portions joined by a pair of sidewalls. As illustrated, the deboss panel profile 114 has a first zone 126, within which the grab portion 54 is located, that is fanned outwardly from a narrower intermediate zone 130 in the vicinity of the rivet 28. The deboss profile 114 widens again in a third zone 134 where the tear panel 20 is located. The first zone 126 is at least as wide at its widest point as the third zone 134 at its widest point.

The billboard surface 58 further has a pigment-carrying layer 138 covering at least a portion of the billboard surface 58. The pigment-carrying layer 138 may be provided by resin, paint, epoxy, coating, anodizing, wax, or any other pigment-carrying solution or solid that is capable of adhering to the billboard surface 58 material.

The tactile indicium 98 preferably overlaps a portion of the pigment-carrying layer 138. This provides further detail and a more pleasing appearance to the indicium 98. More preferably, the pigment-carrying layer 138 has a profile shape substantially matching a profile shape of the tactile indicium 98. The profile shape of the pigment-carrying layer 138 corresponds in size, shape, and location to a size, shape and location of the tactile indicium 98. Most preferably, the billboard surface 58 has a plurality of pigment-carrying layers 138. Each layer 138 is associated with a design feature on the tactile indicium 98 having a separate pigment characteristic, such as shade or color.

Figure 4:
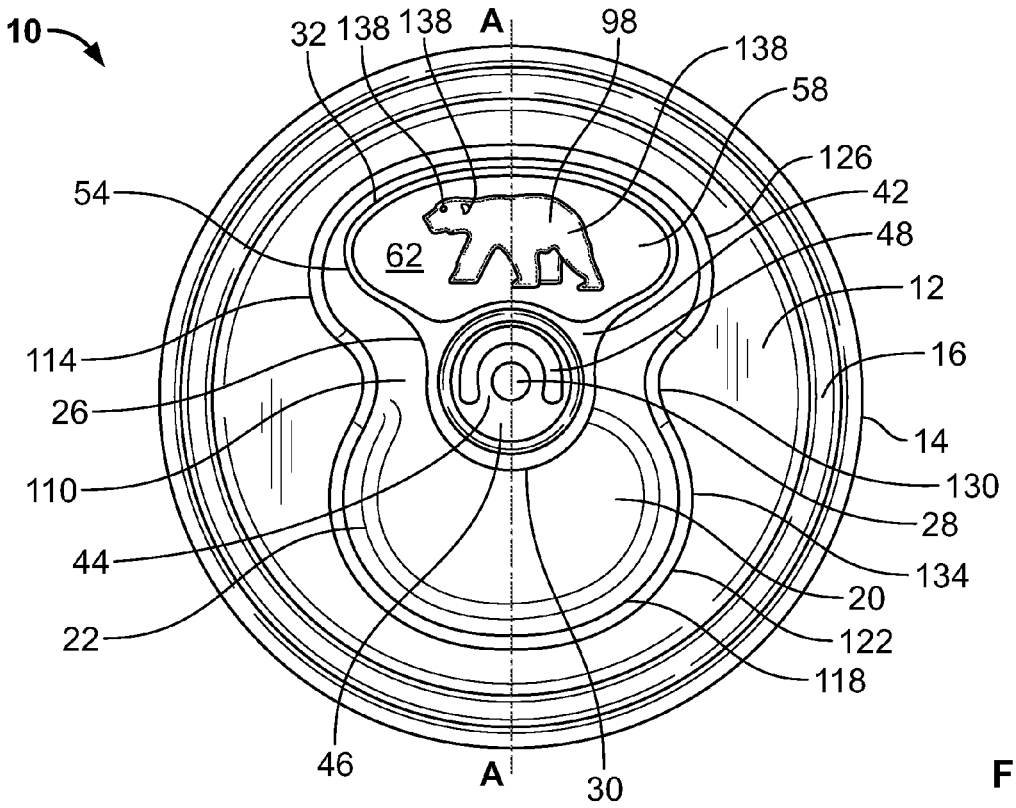
FIG. 4 is a top view of a can end with a tab having a raised bear emblem.

For example, in FIG. 4, one layer 138 may be a shade of white to indicate a polar bear's body while another layer 138 may be a darker shade to represent details such as the ears, eyes, and nose.

Figure 5:
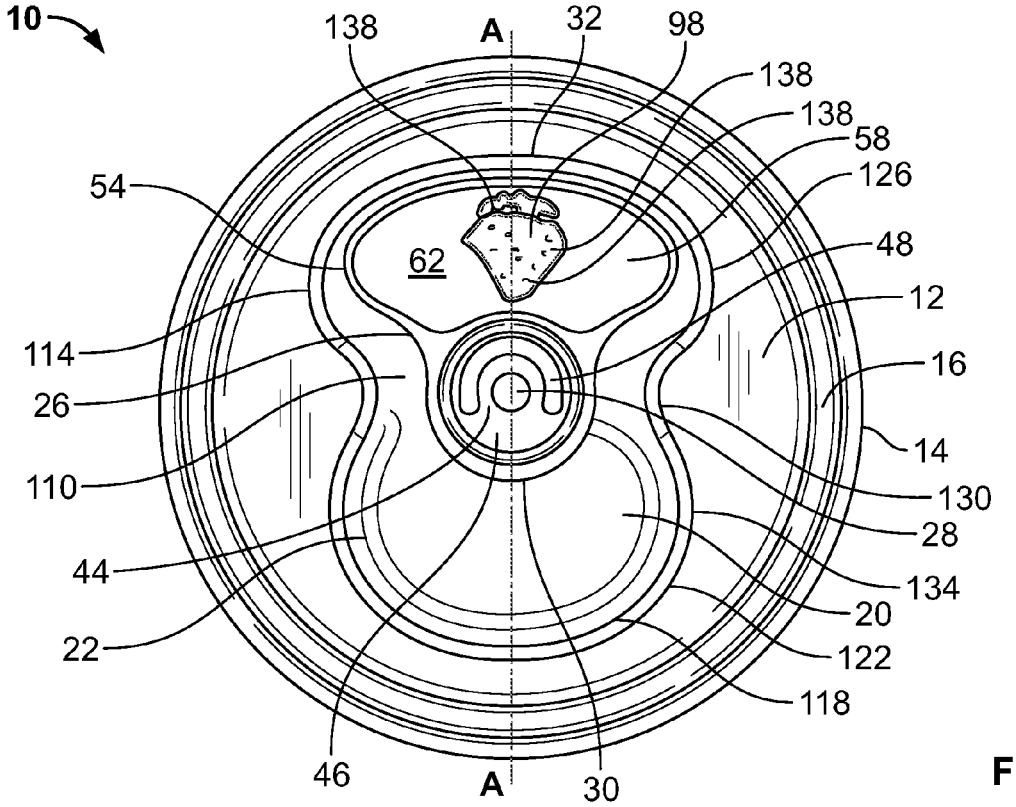
FIG. 5 is a top view of a can end with a tab having a raised strawberry emblem.
Figure 6:
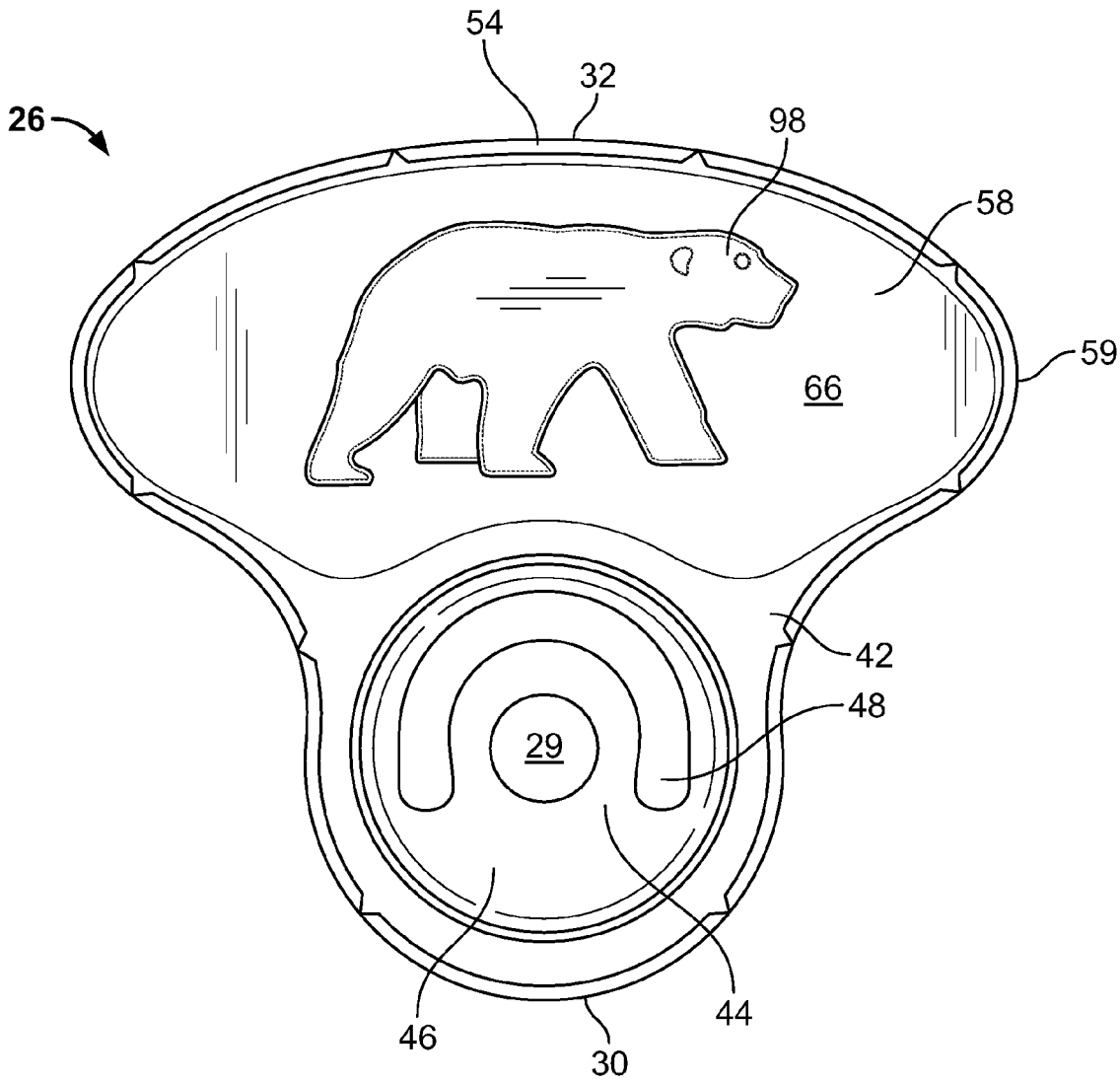
FIG. 6 is a bottom view of the bear emblem tab only, showing the bear emblem on the bottom is recessed rather than raised.
Figure 7:
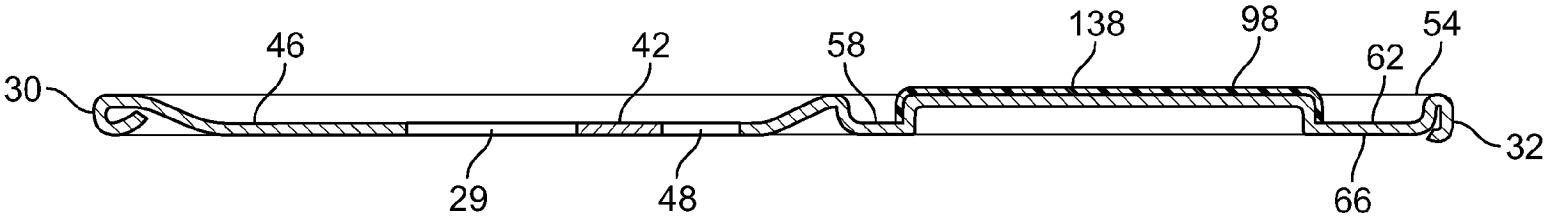
FIG. 7 is a partial cross-sectional view of the tab having the bear emblem taken through a portion of the bear emblem.
Figure 8:
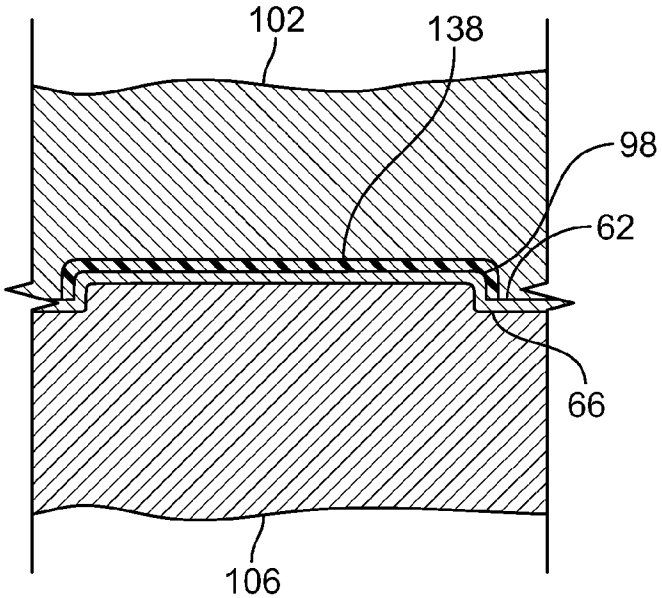
FIG. 8 is a cross-section of a tab similar to FIG. 5 showing tooling for forming the bear emblem.
Figure 9:
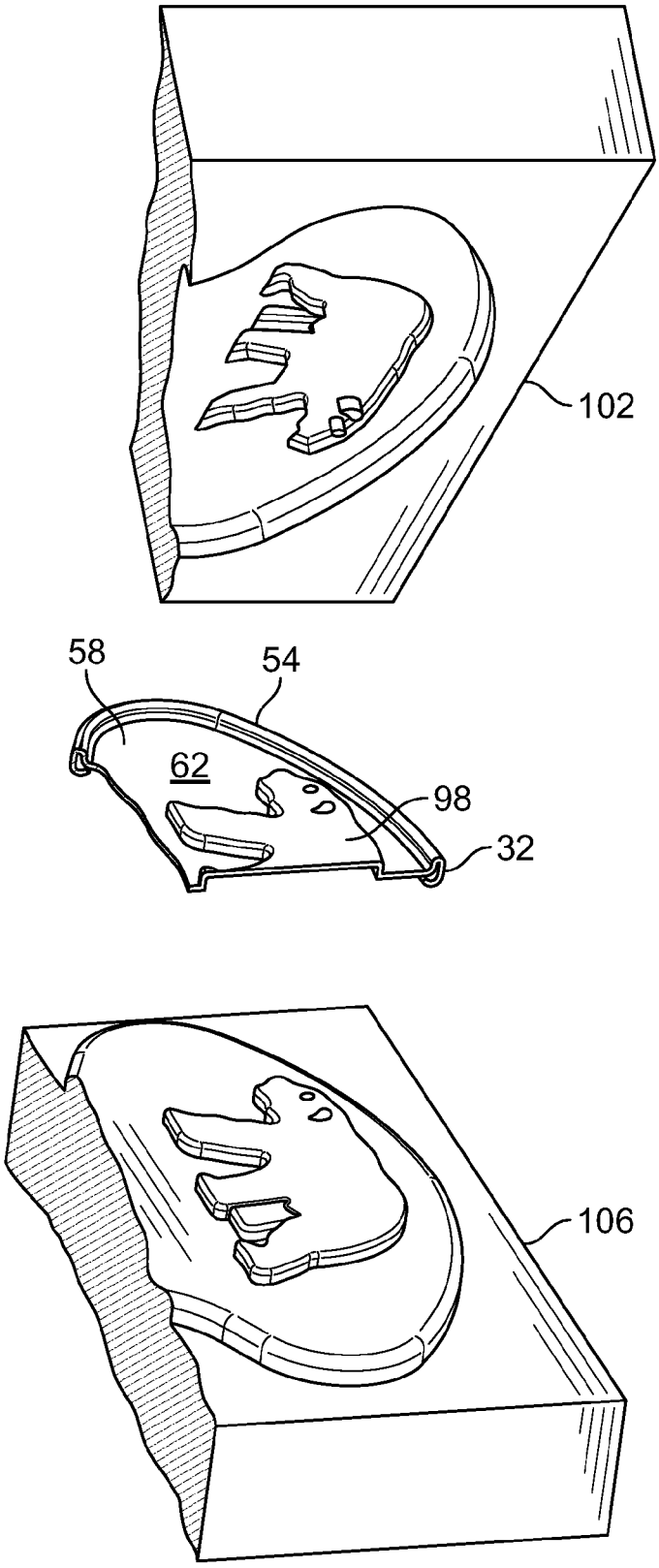
FIG. 9 is an alternative view of the tooling provide to form the bear emblem.

Another example is illustrated in FIG. 5, if the tactile indicium 98 is a strawberry, one layer 138 may be red; another layer 138 may be darker to highlight the location and appearance of the strawberry pips; and another layer 138 may be green to highlight the location and appearance of strawberry leaves.

Thus, the tactile indicium 98 has a profile shape corresponding in size, shape and location on the billboard surface 58 to an overall profile of the plurality of pigment-carrying layers 138, and each pigment-carrying layer 138 represents a separate feature of the tactile indicium 98.

Figure 10:
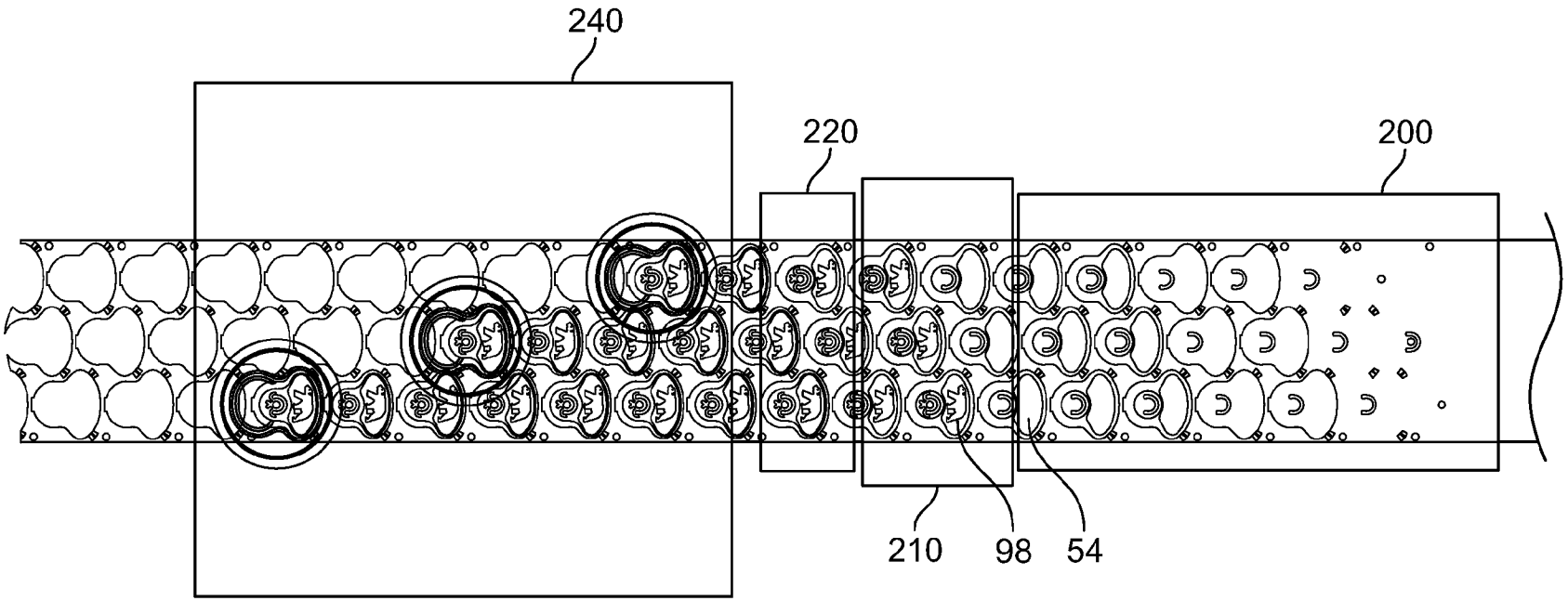
FIG. 10 is a progression diagram showing formation of the tab of the present invention.

Referring specifically to FIG. 10, a method and apparatus for forming the tab 26 of the present invention is illustrated. This method and apparatus is typical of tab formation known in the industry with some exceptions. First, the shape of a tab, which is larger than an actual finished tab, is blanked out of a strip of metal that is unreeled from a metal strip coil at a die station 200. It should be noted the completed tab is not totally detached from, but remains partly joined to, the strip by a joint or "carry strip" until such time as the tab is attached (staked) to an end panel. Thereafter, the tab blank is formed with a predetermined pattern of convex and concave shapes, and curled (for improved rigidity) along its peripheral edge into a final tab profile.

The method of the present invention includes an embossing station 210 where the billboard panel 54 is reformed with an embossed bead. The billboard surface may be laser etched at laser marking station 220.

At the laser marking station 220, a laser may ablate the billboard surface to remove layer(s) of the pigment carrying layer to further enhance and sharpen the appearance of the embossed bead without adversely affecting the reformed billboard shape and embossed nature.

Next, the tabs are severed from the strip, while the tab is fixed to a rivet on a can end through the rivet hole in the rivet island at lane die 240.

One of ordinary skilled in the art would understand that the principles of the present invention are readily adaptable to large opening ends and other types of beverage ends as well as the stay-on-tab ends shown in the drawings, and could be provided with food container ends as well, such as on a full open end.

Additionally, the terms "first," "second," "upper," "lower," "top," "bottom," etc. are used for illustrative purposes relative to other elements only and are not intended to limit the embodiments in any way. The term "plurality" as used herein is intended to indicate any number greater than one, either disjunctively or conjunctively as necessary, up to an infinite number. The terms "joined," "attached," and "connected" as used herein are intended to put or bring two elements together so as to form a unit, and any number of elements, devices, fasteners, etc. may be provided between the joined or connected elements unless otherwise specified by the use of the term "directly" and/or supported by the drawings.

While the specific embodiments have been illustrated and described, numerous modifications come to mind without significantly departing from the spirit of the invention, and the scope of protection is only limited by the scope of the accompanying Claims.

What is claimed is:

1. A tab for a container having a selectively openable panel defined at least in part by a frangible score groove in a surface of the container, the frangible score groove selectively fracturable by a lifting action administered by a user to the tab, the tab comprising:

a nose portion;

a lift end opposite the nose portion;

a central webbing between the nose portion and the lift end, the central webbing having a hinge region and a rivet island, the rivet island being at least partially surrounded by a first void region, the central webbing further having a grab portion at the lift end of the tab, the grab portion having an enclosed region defining a billboard surface having a top side and a bottom side opposite the top side; and a bead created by a displaced portion of the central webbing located on the billboard surface comprising relief features of the tab material on the top and bottom sides of the billboard surface.

2. The tab of claim 1 wherein the bead includes a tactile indicium located on the billboard surface.

3. The tab of claim 2 further comprising a pigment-carrying layer covering at least a portion of the billboard surface.

4. The tab of claim 2 wherein the tactile indicium comprises an embossed figure on the top side and a corresponding debossed figure on the bottom side.

5. The tab of claim 2 wherein the tactile indicium overlaps a portion of a pigment-carrying layer.

6. The tab of claim 5 wherein the pigment-carrying layer has a profile shape substantially matching a profile shape of the tactile indicium.

7. The tab of claim 2 wherein a width of the tab across the billboard surface is at least 50% greater than a width of the tab across the rivet island.

8. The tab of claim 2 further comprising a pigment-carrying layer located on the top side of the billboard surface and wherein the tactile indicium includes an embossed figure on the top side of the billboard surface substantially corresponding in size, shape, and location to a size, shape and location of the pigment-carrying layer.

9. The tab of claim 2 further comprising a plurality of pigment-carrying layers each having a separate pigment characteristic.

10. The tab of claim 9 wherein the tactile indicium has a profile shape corresponding in size, shape and location on the billboard surface to an overall profile of the plurality of pigment-carrying layers wherein each pigment-carrying layer represents a separate feature of the tactile indicium.

11. The tab of claim 10 wherein the tactile indicium includes a first relief feature on the top side of the billboard surface and a second relief feature on the bottom side of the billboard surface.

12. The tab of claim 11 wherein the first relief feature is an embossed figure and the second relief figure is a debossed figure.

13. The tab of claim 12 wherein each of the pigment-carrying layers are located on the top side of the billboard surface.

14. The tab of claim 2 wherein the billboard surface is substantially fan-shaped and has a width at least 50% greater than a width of the tab taken through the rivet island.

15. A tab for a container having a selectively openable panel defined at least in part by a frangible score groove in a surface of the container, the frangible score groove selectively fracturable by a lifting action administered by a user to the tab, the tab comprising:

a nose portion;

a lift end opposite the nose portion;

a central webbing between the nose portion and the lift end, the central webbing having a hinge region and a rivet island, the rivet island being at least partially surrounded by a first void region, the central webbing further having a grab portion at the lift end of the tab, the grab portion having an enclosed region defining a billboard surface having a top side and a bottom side opposite the top side;

an indicium created from a bead located on the billboard surface comprising tactile features on the top and bottom sides wherein the indicium comprises an embossed figure on the top side and a corresponding debossed figure on the bottom side.

16. The tab of claim 15 wherein the indicium further comprises a first layer of a pigment-carrying material.

17. The tab of claim 16 wherein the indicium further comprises a second layer of a pigment-carrying material having a distinct visual characteristic from the first layer.

18. The tab of claim 17 wherein the embossed figure and the first and second layers are located on the top side of the billboard surface.

19. A can end for a container comprising:

a curl defining an outer perimeter of the can end;

a wall extending downwardly from the curl;

a strengthening member joined to a lowermost end of the wall;

a center panel joined to the strengthening member a center panel centered about a longitudinal axis, and having a product side, a public side, a rivet, and a displaceable tear panel center panel at least substantially defined by a frangible score and a non frangible hinge segment; and a non-detachable tab staked to the panel by the rivet, the non-detachable tab having a nose end extending over a portion of the tear panel, a lift end opposite the nose end, and a central webbing between the nose and lift end, the webbing having a hinge region and a rivet island surrounding the rivet, the rivet island being at least partially surrounded by a first void region to provide a first exposed area of the center panel, the non-detachable tab further having an indicium-bearing grab portion having a width at least 50% wider than a width of the tab intersecting the rivet, wherein the center panel includes a deboss panel recessed therein, and the tab is located within the deboss panel wherein deboss panel has a deboss profile including a first zone, within which the grab portion is located, that is fanned outwardly from a narrower intermediate zone in a vicinity of the rivet which widens to a third zone in which the tear panel is located, the first zone being at least as wide at its widest point as the third zone at its widest point.

* * * * *